United States Patent [19]

Chu

[11] Patent Number: 4,962,922

[45] Date of Patent: Oct. 16, 1990

[54] APPARATUS FOR CIRCULATING ARTIFICIAL SNOW

[76] Inventor: Ven-Chung Chu, 3 Fl., No. 3, Lane 42, Yu Hsi St., Yung Ho City, Taipei Hsien, Taiwan

[21] Appl. No.: 440,327

[22] Filed: Nov. 22, 1989

[51] Int. Cl.[5] ..... A63J 5/02

[52] U.S. Cl. ..... 272/15; 40/410; 47/23

[58] Field of Search ..... 272/6, 15, 22 B, 8 R, 272/8 N; 47/23; 40/410, 430, 409, 431, 435, 502

[56] References Cited

U.S. PATENT DOCUMENTS

| | | | |
|---|---|---|---|
| 901,319 | 10/1908 | Bruen | 272/15 |
| 3,147,175 | 9/1964 | Gonzalez | 272/15 |
| 3,243,183 | 3/1966 | Scranage | 272/15 X |
| 3,415,512 | 12/1968 | Burnbaum | 272/15 |
| 3,415,513 | 12/1968 | Burnbaum | 272/15 |
| 4,028,830 | 6/1977 | Ottinger | 272/15 X |
| 4,076,234 | 2/1978 | Burnbaum | 272/15 |
| 4,641,445 | 2/1987 | Rossi | 272/15 X |

*Primary Examiner*—Richard E. Chilcot, Jr.
*Attorney, Agent, or Firm*—Bacon & Thomas

[57] ABSTRACT

Apparatus for use with a Christmas tree cascades artificial snow particles through the tree branches. The apparatus includes a substantially conical collecting receptacle having an interior surface formed with means for better directing snow particles by force of gravity alone into a sump portion. The invention further includes a small air intake hole formed in the particle inlet for facilitating communication with the sump portion of the receptacle and the particle outlet. The deflector atop the tree is provided with a fan for facilitating the dispersion of particles discharged by particle outlet conduit.

3 Claims, 3 Drawing Sheets

APPARATUS FOR CIRCULATING ARTIFICIAL SNOW

BACKGROUND OF THE INVENTION

This invention relates to apparatus for cascading artificial snow through the branches of a decorative tree such as Christmas tree, and more particularly, of the type disclosed in U.S. Pat. No. 4,076,234 entitled Artificial Snow Circulating Apparatus.

This patent discloses apparatus which continuously cascades artifical snow e.g. irregularly shaped particles of foamed plastic through the branches of a Christmas tree. The apparatus seeks to provide a receptacle cone of paperboard construction having an interior surface sufficiently smooth and inclined to feed snow particles downwardly into a sump portion without mechanical assistance. A blower mounted on the tree trunk has an inlet for taking up snow particles collected in the sump portion of the receptacle, and feeds an outlet conduit which channels a stream of particles to a point adjacent the top of the tree. A deflector at the top of the tree directs snow particles emanating from the outlet conduit downwardly through the branches of the tree and back toward the receptacle, where they are recircluated.

While the foregoing aparatus operates successfully, it has several drawbacks. First, the irregularly shaped particles tend to collect on the sloping interior surface of the receptacle. Also, not enough air is intaken with the particles by the blower into the inlet conduit. Lastly, the blower alone is not powerful enough to disperse properly, by means of the deflector, the snow particles.

SUMMARY OF THE INVENTION

Accordingly, a primary object of the present invention is to provide a receptacle of design which more effectively facilitates the feed of the snow particles to the sump portion without mechanical assistance, i.e. by gravity alone. Such a receptacle is provided by a cone constructed from a sheet of pliable material in the form of a circular disc having a radial cut between its perimeter and its aperture 28. The edges of the radial cut are reinforced with a rigid material such that in overlapping to form the cone the rigid reinforced edges further provide a rigid radial guide for better encouraging the snow particals into the sump portion.

Another object of the present invention is to provide an improved circulating means for more effectively dispersing the snow particles by means of the deflector through the tree branches to achieve a more aesthetically pleasing effect. The improved circulating means includes an air inlet formed in the particle inlet conduit for better air intake along with the particles. A fan is further disposed within the deflecting means such that the snow particles discharged by the outlet are more thoroughly dispersed by the deflector.

Further objectives and advantages of the present invention will become apparent as the following description proceeds, and the features of novelty which characterize the invetntion are pointed out with particularity in the claims annexed to and forming a part of this invention.

DETAILED DESCRIPTION OF THE PREFERRED EMBODIMENT

Figure 1:
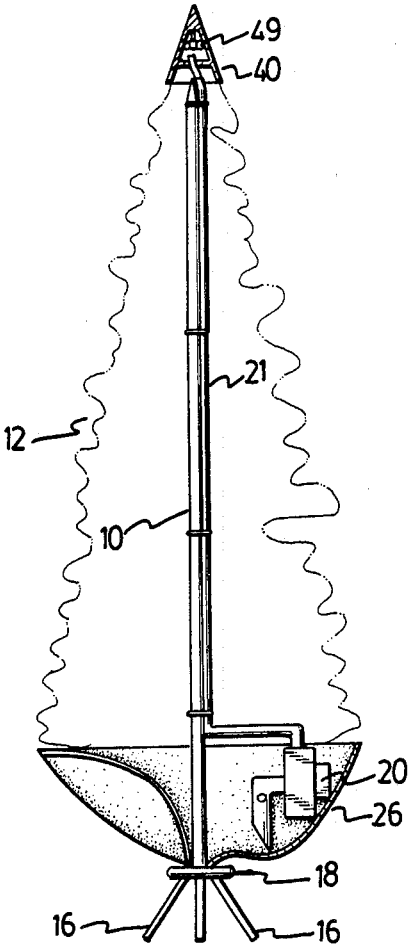
FIG. 1 is a perspective view of an artificial Christmas tree in combination with a particle recirculator embodying the invention.

Referring to the drawings and initially to FIG. 1, it can be seen that an apparatus for artificial snow recirculation in accordance with the present invention installed on a Christmas tree, either artificial or realm that has a trunk 10 from which tree branches, the tips of which are schematically illustrated at 12, extend laterally. The tree is secured on a surface 15 by a conventional tree stand 14 having legs 16 attached to a collar 18 which receives the trunk 10. A blower shown at 20 and a fan 49 constitute the circulating. Extending downwardly parallel to the tree trunk 10 from the blower 20 is a particle inlet conduit 23 for taking up artificial snow particles. Formed in the particle inlet conduit 23 is an air inlet hole 231 for facilitating the intake of air along with artificial snow particles into the particle inlet conduit 23. The blower feeds an outlet conduit 21 for channeling particles upwardly toward a deflector 40 adjacent the top of the tree. A fan 49 established above the particle outlet conduit within the deflector 40 for facilitating the dispersion of the snow particles downwardly through the branches by means of the deflector 40.

Figure 2:
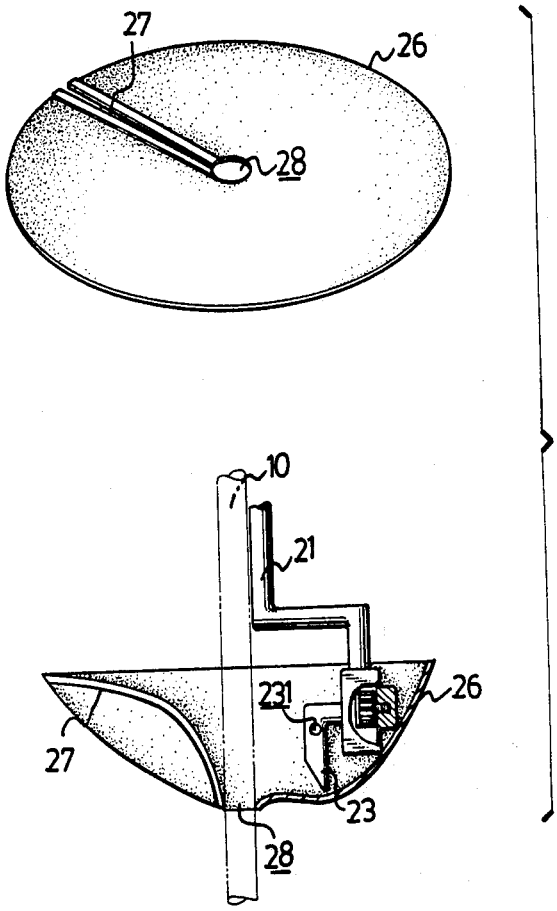
FIG. 2 is a perspective view of the particle collecting receptacle of the recirculator shown in FIG. 1.
Figure 3:
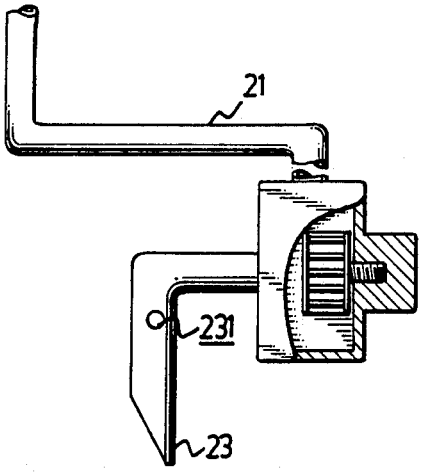
FIG. 3 is a cross-sectional view of the blower, particle inlet conduit, and particle collecting receptacle of the recirculator shown in FIG. 1.

FIGS. 2 and 3 illustrate the particular structure of a particle collecting receptacle 26 of the recirculator. The particle collecting receptacle 26 has a substantially conical structure including a rigid radial guide 27 which encourages snow particles downwardly into a lower sump portion 36, and a central aperture 28. The receptacle is installed about the base of the trunk 10 above the stand 14 and below the blower 20. The receptacle is constructed from a sheet of pliable material in the form of a circular disc having a radial cut between its perimeter and its aperture 28. The edges of the radial cut are reinforced by a rigid material. After being placed about the tree trunk, the radial edges of the receptacle are overlapped to form the slightly deformed cone as shown and held together by suitable fasteners 19.

As shown in FIG. 2, the receptacle has an interior surface 32 which is inclined downwardly with respect to the central axis at an angle sufficient to guide particles into the sump 36 without mechanical assistance, i.e. by the force of gravity alone. Furthermore, the fastened radial edges provide a rigid radial guide 27 which encourages the particles into the sump portion 36. Since the receptacle 26 is not symmmetrical about its central axis, but rather formed such that the sump portion 36 constitutes the vortex of the cone, the snow particles have no tendency to collect along the sides of the receptacle, but completely collect in the sump protion 36 for increasing the effecacy of the circulation means.

Figure 4:
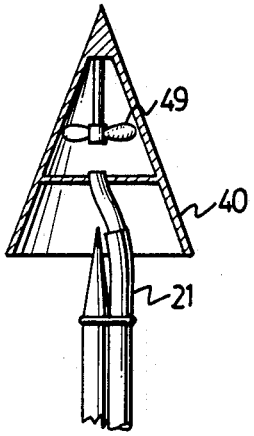
FIG. 4 is a cross-sectional view of the fan and the deflecting means shown in FIG. 1.

FIG. 3 shows the particular feature of the particle inlet conduit, such that during operation, artificial snow paricles placed in the sump 36 of the receptacle 26 and additional air through the air inlet 231 are taken up by the blower through the inlet conduit 23. The stream of particles buoyed in additional air is transported through the outlet conduit 21 for discharge into the interior of the deflector 40. A fan 49, as shown in FIG. 4, provides the stream of particles with additional impetus such that the particles when deflected by the deflector 40 cascade in a more aesthetically pleasing manner down through the branches of the tree. On entering the receptacle 26 the snow particles are guided by the rigid radial guide 27 and the force of gravity downwardly into the sump 36. Fewer particles collect along the inclined walls 34 of the receptacle 26 because the rigid radial guide 27 feeds the particles more effectively into the sump portion 36.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. In an apparatus for use with a tree for continuously cascading artifical snow particles through branches thereof, said apparatus including a particle receptacle cone constructed from a sheet of a pliable material provided in the form of a circular disc having a radial cut between a perimeter thereof and an aperture thereof, said radial cut forming two radial edges which overlap to form said receptacle cone including an interior surface with sufficient smoothness and sufficient downward incline from the periphery thereof to the cone axis such that, when said receptacle is installed at the base of the tree, gravitational force alone moves the particles along said interior surface into a bottom sump portion of said receptacle, a blower having an inlet conduit for taking up particles contained in said sump portion and an outlet conduit for delivering said particles to a point adjacent the top of the tree, and deflecting means which, when installed atop the tree, directs particles received from as outlet conduit downwardly through the branches of the tree into said receptacle; the improvement wherein said radial edges being reinforced with a rigid material such that when overlapped to form said receptacle cone said radial edges together form a rigid radial guide for encouraging said artificial snow particles into said sump portion of said receptacle cone.

2. Apparatus according to claim 1 having the further improvement wherein said inlet conduit is formed with an air inlet hole for intake of additional air along with said artificial snow particles into said inlet conduit.

3. Apparatus according to claim 1 having the futher improvement wherein said outlet conduit is provided with a fan for better dispersement of particles received by said outlet conduit and directed by said deflecting means.

* * * * *